US005644914A

United States Patent [19]

Deavers et al.

[11] Patent Number: 5,644,914

[45] Date of Patent: Jul. 8, 1997

[54] EXHAUST PRESSURE PULSATION CONTROL APPARATUS FOR A MARINE PROPULSION SYSTEM

[75] Inventors: Gregory B. Deavers, Perkins; Loren T. Powers, Stillwater; George E. Brown, Perkins, all of Okla.

[73] Assignee: Brunswick Corporation, Lake Forest, Ill.

[21] Appl. No.: 512,026

[22] Filed: Aug. 7, 1995

[51] Int. Cl.[6] ..... F01N 3/02

[52] U.S. Cl. ..... 60/310; 440/89

[58] Field of Search ..... 60/324, 310; 440/89; 181/260, 264, 270

[56] References Cited

U.S. PATENT DOCUMENTS

| | | | |
|---|---|---|---|
| 1,048,435 | 12/1912 | Still | 181/260 |
| 2,485,555 | 10/1949 | Bester | 181/260 |
| 3,130,541 | 4/1964 | Babbit | 60/310 |
| 3,166,895 | 1/1965 | Slayter | 60/299 |
| 4,055,231 | 10/1977 | Martinez | 181/264 |
| 4,326,374 | 4/1982 | Streb | 440/89 |
| 4,573,318 | 3/1986 | Entringer et al. | 60/310 |
| 4,609,068 | 9/1986 | Backlund | 181/226 |
| 4,643,272 | 2/1987 | Gaffrig | 181/260 |
| 4,781,021 | 11/1988 | Winberg | 60/310 |
| 4,845,945 | 7/1989 | Widmer et al. | 60/310 |

OTHER PUBLICATIONS

CP Slip–In Silencer II, Buyer's Guide, p. 109, Powerboat, Jun. 1995.

The Shotgun Exhaust Silencer, Buyer's Guide, p. 113, Powerboat, Jun. 1995.

Stainless Steel 4" Muffler Tip Inserts, Buyer's Buide, p. 114, Powerboat, Jun. 1995.

*Primary Examiner*—Douglas Hart

*Attorney, Agent, or Firm*—Andrus, Sceales, Starke & Sawall

[57] ABSTRACT

An exhaust pressure pulsation control apparatus for a marine propulsion system has a front ring and a reflector disk located downstream of the front ring. There is a space between the front ring and the reflector disk that is sufficiently large so that the mixture of water and water cooled exhaust passing through the apparatus does not have a significant pressure drop. The apparatus attenuates pressure pulsations in the exhaust system, thereby significantly reducing water ingestion through the exhaust system into the engine. The apparatus does not create significant exhaust back pressure, and typically increases engine maximum power output.

20 Claims, 3 Drawing Sheets

EXHAUST PRESSURE PULSATION CONTROL APPARATUS FOR A MARINE PROPULSION SYSTEM

FIELD OF THE INVENTION

The invention is an exhaust pressure pulsation control apparatus for a marine propulsion system. The invention is particularly useful for reducing water ingestion through an engine exhaust system back into the engine.

BACKGROUND AND SUMMARY OF THE INVENTION

In a typical inboard/outboard or inboard marine propulsion system, hot exhaust gases from engine cylinders discharge into an exhaust manifold which directs the hot exhaust gases into a water jacketed exhaust elbow. The exhaust elbow normally has a generally vertical intake exhaust passage, and then bends around to a slightly downward sloping discharge exhaust passage. The hot exhaust gases flow into the exhaust elbow through the intake passage and exit the elbow through the exhaust discharge passage. Cooling water from the engine inputs the exhaust elbow water jacket from the same side as the exhaust intake and generally flows through the water jacket to the exhaust discharge where the coolant water is mixed with the hot exhaust gases. By mixing the coolant water with the exhaust gases, the exhaust gases are cooled. The mixture of exhaust gases and coolant water is then typically discharged through an exhaust bellows or exhaust tube and then through the transom, or the propeller torpedo, or the like.

It is sometimes desirable to discharge the mixture of cooled exhaust gases and spent coolant water through the transom of the boat above the surface of the water. Discharging below the water surface tends to create an exhaust back pressure which, under certain high performance conditions, can reduce the power output of the propulsion system. In high performance applications, it is also desirable to reduce the creation of exhaust back pressures during acceleration.

In systems where the exhaust tube passes through the transom of the boat to discharge the cooled exhaust gases and spent coolant water above the surface of the water (i.e. through-transom exhaust systems, water ingestion through the exhaust system back into the engine can be a significant problem. In through-transom exhaust systems, exhaust pressure pulsations due to reciprocating piston movement and valve overlap tend to suck water within the exhaust tube back into the engine. Water or moisture actually travels backwards into the interior of the exhaust passage within the elbow in a pulsating manner and eventually back into the engine. The pulsating water ingestion becomes more pronounced as engine size increases, especially in propulsion systems having little or no exhaust back pressure. This is typically true of high performance marine propulsion systems having through-transom exhaust systems.

The invention provides a practical apparatus which eliminates exhaust pressure pulsation water ingestion without creating back pressure in the exhaust system. The invention is especially useful in through-transom exhaust systems, or in other exhaust systems in which the cooled exhaust gases and spent coolant water are discharged above the surface of the water. U.S. Pat. Nos. 4,845,945 and 4,573,381, which are assigned to the assignee of the present application, disclose a water jacketed exhaust elbow and a trough for a water jacket exhaust elbow which are designed to reduce pulsating water ingestion. The present invention involves attenuating pressure pulsations in the exhaust system by placing an exhaust pressure pulsation control apparatus in the exhaust tube downstream of the exhaust elbow. The exhaust pressure pulsation control apparatus is preferably used in conjunction with a water jacketed exhaust elbow as disclosed in the above mentioned patents.

DETAILED DESCRIPTION OF THE DRAWINGS

Figure 1:
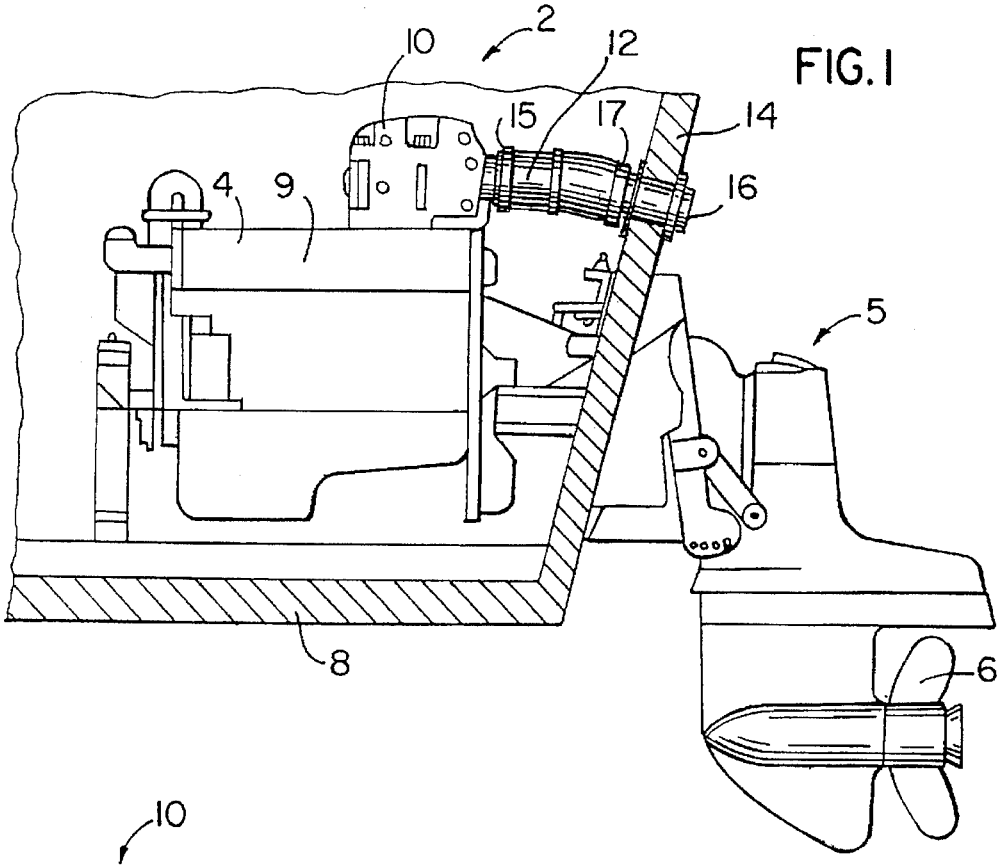
FIG. 1 is a view of a marine propulsion system in accordance with the invention having a through-transom exhaust discharge.

FIG. 1 is a side view of an inboard/outboard marine propulsion system 2 having an internal combustion engine 4, and an outdrive 5 having a propeller 6 for propelling the boat 8. The propulsion system 2 in FIG. 1 has a through-transom exhaust system. Hot exhaust gases from the engine cylinders discharge into two exhaust manifolds 9: one on the left side and one on the right side. Each exhaust manifold 9 directs the hot exhaust gases into a water jacketed exhaust elbow 10. In the exhaust elbow 10, the hot exhaust gases are mixed with coolant water from the engine and the mixture is then discharged through exhaust bellows tube 12 through the transom 14 into the atmosphere.

Each of the exhaust bellows tube 12 is connected to the exhaust elbow 10 with a clamp 15 and to a transmission exhaust mount 16 with a clamp 17. Although not shown on FIG. 1, it may be desirable to provide a flapper over the exhaust discharge outlet of the transom exhaust mounts 16 to prevent water from backsplashing into the exhaust.

Figure 2:
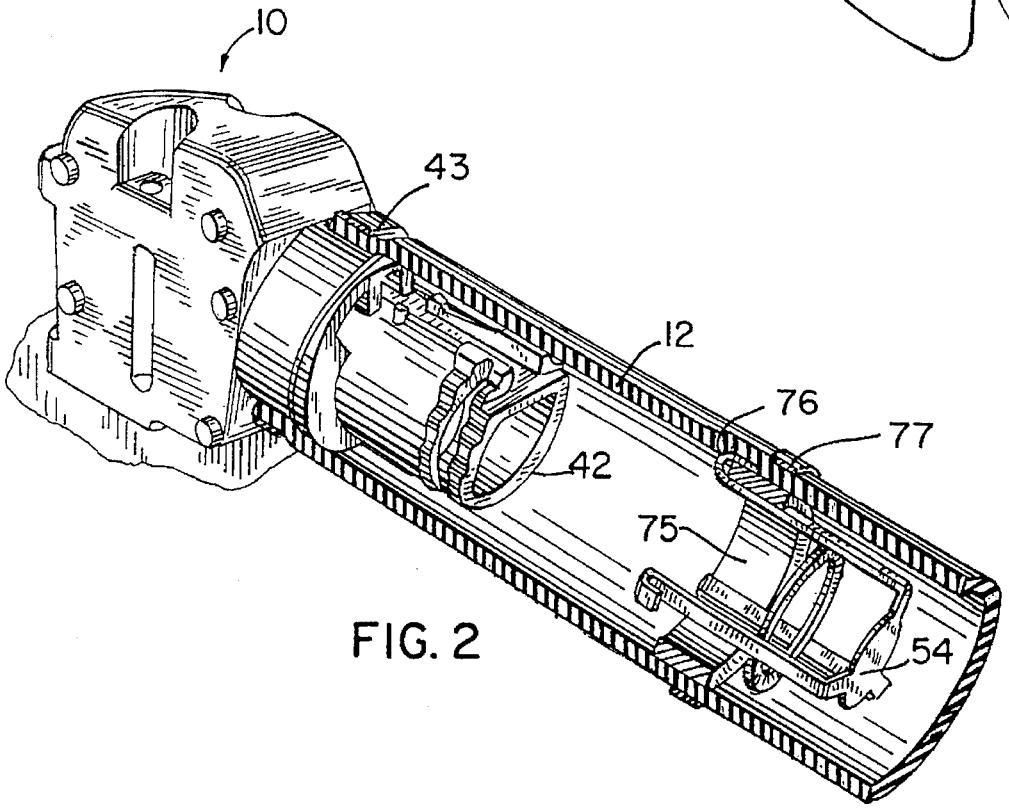
FIG. 2 is a perspective view of a part of an exhaust system constructed in accordance with the invention.
Figure 3:
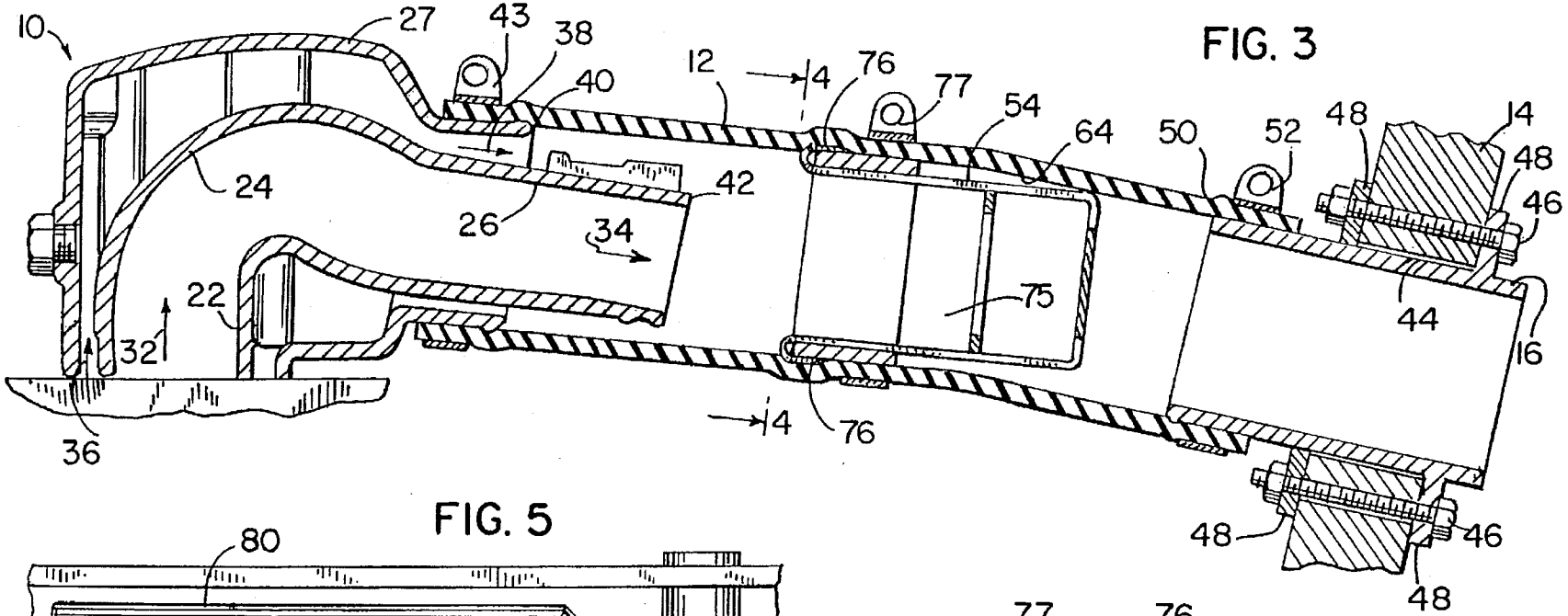
FIG. 3 is a sectional view of the exhaust system of FIG. 2.
Figure 4:
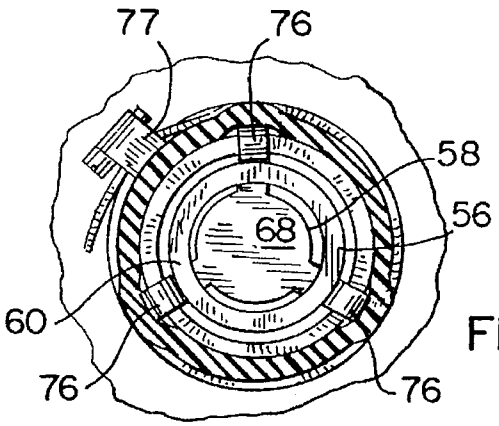
FIG. 4 in a sectional view taken along line 4—4 in FIG. 3.

Referring now to FIGS. 2 and 3, the exhaust elbow 10 is similar to the exhaust elbow disclosed in U.S. Pat. No. 4,573,318 which is assigned to the assignee of the present patent application. The exhaust elbow 10 includes an intake exhaust passage 22 extending upwardly from the engine and communicating through a top bend 24 with a discharge exhaust passage 26. The discharge exhaust passage 26 extends slightly downward at about a 7° angle from horizontal. An outer water jacket 27 is around the exhaust passage 22, 24 and 26. Exhaust flows from the engine manifold 9 upwardly as shown by arrow 32, around the bend 24, and is discharged from the exhaust elbow 10 in the direction shown by arrow 34. Coolant water flows from the engine 4 upwardly as shown at arrow 36. The coolant water exits the water jacket 27 as shown by arrow 38. The water jacket 27 terminates at end 40 upstream of the gas discharge end tip 42 of the discharge exhaust passage 26. Exhaust bellows tube 12 is connected by a band clamp 43 or the like around end 40 of the water jacket 27 and extends externally downstream from the water jacket 27 around discharge exhaust passage 26. The exhaust bellows tube 12 discharges the spent coolant water and water-cooled exhaust gases through the transom 14 of the boat.

The exhaust gases entering the exhaust elbow 10 in the direction of arrow 32 have a relatively high temperature (e.g. approximately 1100° F. at idle). When the exhaust gases exit the exhaust elbow 10 through the tip 42 of the exhaust discharge passage 26, the coolant water mixes with the hot exhaust gases, thereby cooling the exhaust gases (e.g. approximately to 150° F. at idle). Inasmuch as the exhaust bellows tube 12 is normally made of rubber, it is important that the exhaust gases entering the tube 12 be cooled.

The exhaust transom mount 16 is mounted through a hole 44 in the transom 14. The transom exhaust mount 16 is mounted to the transom 14 by attaching bolts 46 through mount flanges 48 and through the transom 14. The rear end 50 of the exhaust bellows tube 12 is mounted to the transom exhaust mount 16 with a clamp 52 or the like.

In accordance with the invention, an exhaust pressure pulsation control apparatus 54 can be located within the exhaust bellows tube 12. The exhaust pressure pulsation control apparatus 54 controls pressure pulsations in the exhaust system (i.e. the exhaust manifold 9, the exhaust elbow 10, the exhaust bellow tube 12 and the transom exhaust mount 16). Uncontrolled pressure pulsations can reduce engine 4 power output and can also induce water ingestion through the exhaust system back into the engine 4. Note that the apparatus 54 controls or attenuates pressure pulsations in the exhaust system without creating significant exhaust back pressure which can impair engine performance in terms of power output.

Referring to FIGS. 2 through 4 and 6 through 8, the exhaust pressure pulsation control apparatus 54 has a front ring 56 and a reflector disk 58 located downstream of the front ring 56. The front ring 56 shown in the drawings is a flat, circular ring having a front face 60 generally perpendicular to the exhaust tube 12. The front ring 56 has an outside circumferential edge 62 which does not necessarily contact the inside circumferential surface 64 of the exhaust tube 12. The reflector disk 58 shown in the drawings is a generally flat, circular disk having a front face 68 that is generally perpendicular to the exhaust tube 12. As shown best in FIGS. 4 and 7, the diameter across the inside circumferential edge 66 of the front ring 56 is preferably larger than the diameter across the reflector disk 58.

Three connecting members 70 connect the reflector disk 58 to the outside circumferential edge 62 of the front ring 56. Each connecting member 70 is preferably L-shaped, having a longitudinal portion 72 and a radial portion 74. The radial portion 74 attaches to the reflector disk 58.

In the preferred embodiment as shown in the drawings, the longitudinal portions 72 of each of the connecting members 70 extends longitudinal beyond the front ring 56 to serve as a mounting arm 74. It is preferred that the entire pressure pulsation control apparatus 54 be made from a heat and corrosion resistant material such as stainless steel, although it is not a requirement of the invention that the entire apparatus 14 be fabricated from the same material. It is preferred that the apparatus 54 be coated (e.g. painting; E-coating; powder painting) or plated (e.g. nickel plate; chrome plate, etc.) to inhibit galvanic reactions between dissimilar materials (e.g. stainless/copper).

In the preferred embodiment, the apparatus 54 is mounted within the exhaust tube 12 using a retainer ring 75 inside of the exhaust tube 12 and clamp 77 located outside of the exhaust tube 12. Each of the mounting arms 74 has a mounting flange 76 which is preferably outwardly curved.

The retainer ring 75 is preferably made of a heat and corrosion resistant material, such as stainless steel. As shown best in FIGS.3 and 4, the exhaust pressure pulsation control apparatus 54 is secured within the exhaust tube 12 by placing the mounting flanges 76 around the retainer ring 75 and clamping the exhaust tube 12 around the retainer ring 75 and the flanges 76 with clamp 77.

It is preferred that the apparatus 54 be positioned in the exhaust tube 12 so that the reflector disk 54 is located at a distance from the outlet 42 of the exhaust elbow 10 sufficient to reduce turbulence in the exhaust tube 12 due to pressure pulsations in the exhaust flow.

While the preferred way of mounting the exhaust pressure pulsation control apparatus 54 within the exhaust tube 12 has been shown in the drawings and described herein, the invention should not be limited to this preferred way of mounting the apparatus 54. The apparatus 54 can be mounted within the exhaust tube 12 in many other ways. For example, the apparatus 54 could be mounted to and forward of the transom exhaust mount 16.

When the mixture of coolant water and water cooled exhaust gases from the exhaust elbow 10 flow through the exhaust tube 12 to the atmosphere, a central cross sectional portion of the flow path of the mixture is obstructed by the front face 68 of the reflector disk 58. Flow through the exhaust tube 12 outside of the central cross sectional portion is obstructed by the front face 60 of the front ring 56. Obstructing the fluid flow through the apparatus 54 in this manner attenuates pressure pulsation in the exhaust system. The attenuation of pressure pulsations is accomplished by the apparatus 54 in part by diffusing the flow of exhaust through the tube 12, and in part by reflecting or tuning the exhaust flow within the exhaust tube.

As the mixture of coolant water and water cooled exhaust gases flows through the apparatus 54, the mixture flows past the front ring 56 and then around reflector disk 58 through the flow spaces 78 between the front ring 56, the reflector disk 58, and the connecting members 70. The flow space 78 has a sufficient flow area so that the mixture of coolant water and water cooled exhaust passing through the apparatus 54 does not have a significant restriction over a full range of operating conditions. It can therefore be appreciated that the apparatus 54 can be used to attenuate exhaust pressure pulsations without creating excessive exhaust back pressure. The apparatus 54 thus reduces water ingestion and also increases engine power output.

Figure 5:
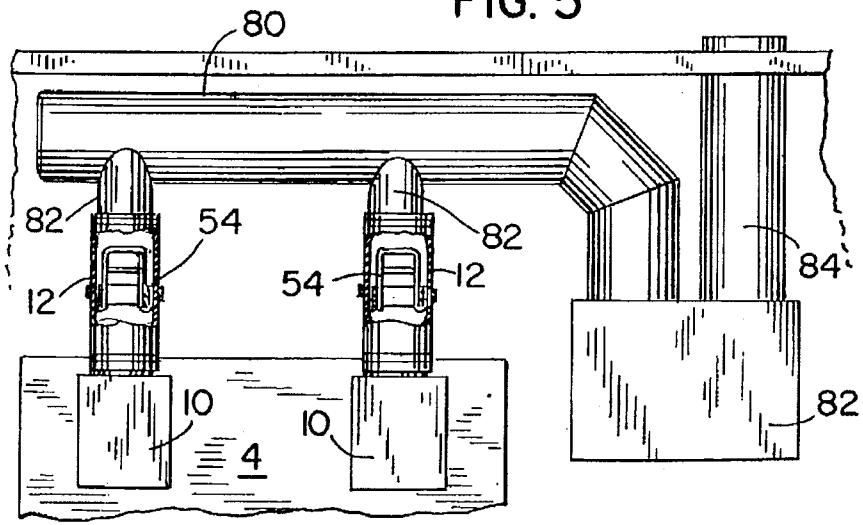
FIG. 5 is a top view of a marine propulsion system in accordance with the invention having an exhaust system with an exhaust collector.
Figure 6:
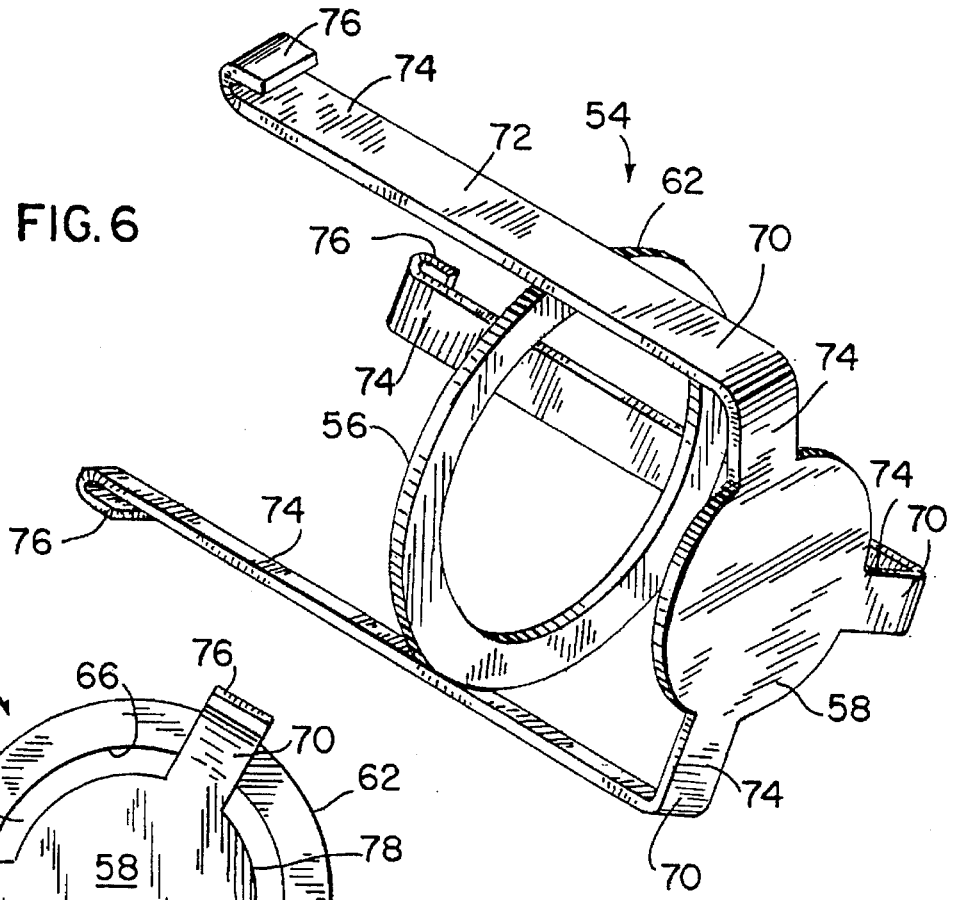
FIG. 6 is a perspective view of an exhaust pressure pulsation control apparatus constructed in accordance with the invention.
Figure 7:
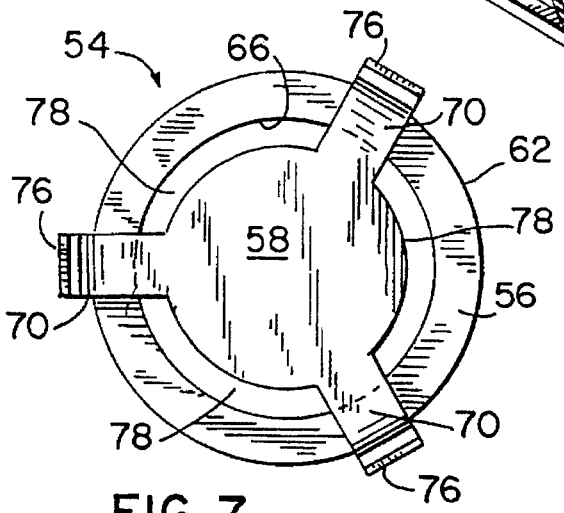
FIG. 7 is an end view of the exhaust pressure pulsation control apparatus shown in FIG. 6.
Figure 8:
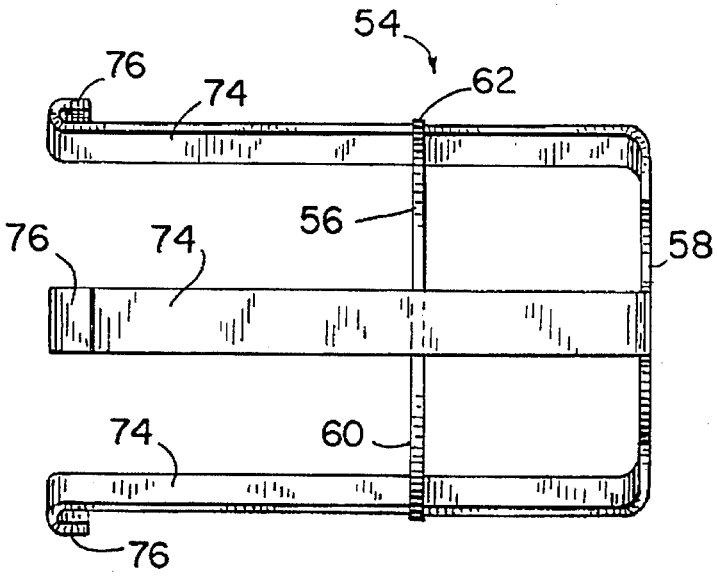
FIG. 8 is a side elevational view of the exhaust pressure pulsation control apparatus shown in FIGS. 6 and 7.

FIG. 1 shows a through-transom exhaust system, however the invention is not limited to using the exhaust pressure pulsation control apparatus 54 in a through-transom exhaust system. Referring to FIG. 5, the exhaust pressure pulsation control apparatus 54 is especially useful in an exhaust system having an exhaust collector 80. Exhaust and coolant water from each of the exhaust elbows 10 is discharged through the exhaust bellow tubes 12 into the exhaust collector 80 through collector ports 82. The exhaust and coolant water in the collector 80 flows to a water lift system 82 and then through a discharge tube 84 to be discharged to the atmosphere. In an exhaust system with an exhaust collector 80, FIG. 5, there can be a tendency to exacerbate exhaust pressure pulsations in the exhaust system located towards the water lift system 82. Inserting the exhaust pressure pulsation control apparatus 54 within the exhaust tubes 12 in a such a system, FIG. 5, attenuates the pressure pulses in both of the exhaust tubes 12 and again reduces water ingestion without increasing exhaust back pressure.

The invention has been described in connection with a marine propulsion system, but use of the invention should not be limited to marine propulsion systems. For instance, the exhaust pressure pulsation control apparatus 54 can be used in automotive applications to reduce pressure pulsation and thereby increase engine power output. Of course, in a marine application, the invention has the additional advantage of reducing water ingestion from the exhaust system into the engine.

Although the drawings show the apparatus 54 with a flat reflector disk that is generally perpendicular to the exhaust tube, it may be desirable in some exhaust systems that the disk be concave or slanted.

It is recognized that various alternatives, modifications and equivalence are possible and should be considered in the scope of the appended claims.

We claim:

1. In a marine propulsion system having an internal combustion engine exhausted through a water jacketed exhaust elbow into and through an exhaust tube, an exhaust pressure pulsation control apparatus located within the exhaust tube comprising:

a front ring;

a reflector disk located downstream of the front ring;

wherein the apparatus is mounted longitudinally within the exhaust tube so that a mixture of water and water cooled exhaust passing through the exhaust tube also passes through the apparatus and a space between the front ring and the reflector disk is sufficiently large so that there is no significant restriction to the mixture of water and water cooled exhaust passing through the apparatus.

2. An exhaust pressure pulsation control apparatus as recited in claim 1 wherein the front ring is a flat, circular ring having a front face generally perpendicular to the exhaust tube.

3. An exhaust pressure pulsation control apparatus as recited in claim 2 wherein the front ring has an outside circumferential edge which does not contact an inside circumferential surface of the exhaust tube.

4. The invention as recited in claim 1 wherein the marine propulsion system has a through-transom exhaust discharge and the reflector disk has a diameter less than an inside diameter of the front ring and the reflector disk is located a distance from an outlet of the exhaust elbow sufficient to reduce turbulence in the exhaust tube.

5. The invention as recited in claim 1 wherein the marine propulsion system has an exhaust system with an exhaust collector and the reflector disk has a diameter that is less than an inside diameter of the front ring and the reflector disk is located about two inches downstream of the front ring.

6. An exhaust pressure pulsation control apparatus as recited in claim 1 wherein the reflector disk is flat and generally perpendicular to the exhaust tube.

7. An exhaust pressure pulsation control apparatus as recited in claim 1 further comprising:

a connecting member which connects the reflector disk to an outside circumferential edge of the front ring.

8. An exhaust pressure pulsation control apparatus as recited in claim 7 further comprising:

a mounting arm connected to the front ring, the mounting arm extending generally longitudinally in a direction away from the reflector disk and having an outwardly curved mounting ear which can be used to secure the apparatus within the exhaust tube.

9. An exhaust pressure pulsation control apparatus as recited in claim 8 wherein the entire apparatus is made from heat and corrosion resistant material, and the connecting member and the mounting arm are integral and attached to the front ring on an outside circumferential edge of the front ring.

10. An exhaust pressure pulsation control apparatus as recited in claim 8 wherein the entire apparatus is coated to prevent galvanic reaction with dissimilar materials.

11. An exhaust pressure pulsation control apparatus as recited in claim 8 wherein the entire apparatus is plated to prevent galvanic reaction with dissimilar materials.

12. The exhaust pressure pulsation control apparatus as recited in claim 8 further comprising:

a stainless steel retainer ring located within the exhaust tube in such a manner that the mounting ear can be placed between the retainer ring and the exhaust tube; and a clamp outside of the exhaust tube which clamps the exhaust tube to the retainer ring to secure the position of the retainer ring.

13. An exhaust pressure pulsation control apparatus to be used in an exhaust tube of an exhaust system for an internal combustion engine, the apparatus comprising;

a front ring;

a reflector disk located downstream of the front ring;

means for removably mounting the apparatus longitudinally within the exhaust tube so that exhaust passing through the exhaust tube also passes through the apparatus;

wherein a space between the front ring and reflector disk is sufficiently large so that there is no significant restriction to fluid passing through the apparatus.

14. In a marine propulsion system having an internal combustion engine exhausted through a water jacketed exhaust elbow and through an exhaust tube, a method of reducing water ingestion through the exhaust system into the engine comprising the steps of:

flowing a mixture of coolant water and water cooled exhaust gases from the exhaust elbow through an exhaust tube to the atmosphere;

obstructing the flow of the mixture through the exhaust tube in a central cross-sectional portion of the flow path of the mixture at a first location in the exhaust tube;

obstructing flow through the exhaust tube outside of the central cross-sectional portion at a second location which is upstream of the first location; and providing a sufficient of flow area through the entire length of the exhaust tube to minimize exhaust back pressure over a full range of operating conditions.

15. A method as recited in claim 14 wherein the central cross-sectional portion of the fluid flow is obstructed in such a manner that pressure pulsations in the exhaust are attenuated.

16. In a marine propulsion system having an internal combustion engine exhausted through a water jacketed exhaust elbow into and through an exhaust tube, an exhaust pressure pulsation control apparatus located within the exhaust tube comprising:

a front ring having an inside diameter;

a reflector disk located downstream of the front ring, the reflector disk having a diameter less than the inside diameter of the front ring;

wherein a space between the front ring and the reflector disk is sufficiently large so that there is no significant restriction to a mixture of water and water cooled exhaust passing through the apparatus.

17. In a marine propulsion system having an internal combustion engine exhausted through a water jacketed exhaust elbow into and through an exhaust tube, an exhaust pressure pulsation control apparatus located within the exhaust tube comprising:

a front ring;

a reflector disk located downstream of the front ring;

a connecting member which directly Connects the reflector disk to an outside circumferential edge of the front ring;

wherein a space between the front ring and the reflector disk is sufficiently large so that there is no significant restriction to a mixture of water and water cooled exhaust passing through the apparatus.

18. In a marine propulsion system having an internal combustion engine exhausted through a water jacketed exhaust elbow into and through an exhaust tube, an exhaust pressure pulsation control apparatus located within the exhaust tube comprising:

a front ring;

a reflector disk located downstream of the front ring;

a connecting member which connects the reflector disk to an outside circumferential edge of the front ring;

a mounting arm connected to the front ring, the mounting arm extending generally longitudinally in a direction away from the reflector disk and having an outwardly curved mounting ear which can be used to secure the apparatus within the exhaust tube;

a stainless steel retainer ring located within the exhaust tube in such a manner that the mounting ear can be placed between the retainer ring and the exhaust tube; and a clamp outside the exhaust tube which clamps the exhaust tube to the retainer ring to secure the position of the retainer ring;

wherein a space between the front ring and the reflector disk is sufficiently large so that a mixture of water and water cooled exhaust passing through the apparatus does not have a significant pressure drop.

19. In a marine propulsion system having an internal combustion engine an exhaust tube receiving a flow of water and water cooled exhaust from the engine, an exhaust pressure pulsation control apparatus located within the exhaust tube to reduce water ingestion from the exhaust tube upstream into the engine, the apparatus comprising a front ring, a reflector disk located downstream of the front ring, and a connecting member that connects the reflector disk to the front ring, wherein the apparatus is mounted longitudinally within the exhaust tube so that the mixture of water and water cooled exhaust passing through the exhaust tube also passes through the apparatus.

20. The apparatus as recited in claim 19 wherein the reflector disk has a diameter less than an inside diameter of the front ring.

* * * * *